US008333332B2

(12) United States Patent
Burghaus et al.

(10) Patent No.: US 8,333,332 B2
(45) Date of Patent: Dec. 18, 2012

(54) SPRAY HEAD WITH A NOZZLE INSERT

(75) Inventors: Johannes Burghaus, Groβ-Umstadt (DE); Markus Klein, Buettelborn (DE); Andreas Pohler, Nauheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 1605 days.

(21) Appl. No.: 11/439,660

(22) Filed: May 24, 2006

(65) Prior Publication Data

US 2007/0057091 A1 Mar. 15, 2007

(30) Foreign Application Priority Data

May 25, 2005 (DE) ..... 10 2005 024 612

(51) Int. Cl.
*B05B 15/02* (2006.01)
*B05B 1/34* (2006.01)

(52) U.S. Cl. ..... 239/114; 239/490

(58) Field of Classification Search ..... 239/114, 239/548, 403, 428, 428.5, 490
See application file for complete search history.

(56) References Cited

U.S. PATENT DOCUMENTS 4,611,759 A * 9/1986 Cox ..... 239/229
4,768,717 A * 9/1988 Shay ..... 239/403
4,779,803 A * 10/1988 Corsette ..... 239/428.5
5,267,692 A * 12/1993 Maas et al. ..... 239/333
5,590,837 A * 1/1997 Grogan ..... 239/478
5,593,094 A * 1/1997 Barriac et al. ..... 239/476
5,711,488 A * 1/1998 Lund ..... 239/333
5,722,598 A * 3/1998 Werding ..... 239/403
5,992,765 A * 11/1999 Smith ..... 239/493
6,132,203 A * 10/2000 Masin ..... 431/121
6,533,196 B1 * 3/2003 Ouin et al. ..... 239/476
7,111,798 B2 9/2006 Thomas et al.
7,481,382 B2 * 1/2009 Christ ..... 239/567
7,886,995 B2 * 2/2011 Togashi ..... 239/463
2002/0060255 A1 5/2002 Benoist
2002/0084289 A1 * 7/2002 Stern et al. ..... 222/402.1
2002/0158154 A1 * 10/2002 Lee ..... 239/548
2004/0074993 A1 * 4/2004 Thomas et al. ..... 239/525
2007/0001029 A1 * 1/2007 Kjeldal et al. ..... 239/406

OTHER PUBLICATIONS

International Search Report, Application No. PCT/US2006/019123, dated Oct. 6, 2006 (6 pages).

* cited by examiner

*Primary Examiner* — Len Tran
*Assistant Examiner* — Steven M Cernoch
(74) *Attorney, Agent, or Firm* — James T. Fondriest

(57) ABSTRACT

A spray head (1) with a nozzle insert (2) for atomizing a fluid, which tends to gum up or harden, from a reservoir, wherein the nozzle insert (2) is substantially designed as a hollow cylinder (3) that is open on one side and has, on the other side, a nozzle opening (4) towards the outside, and the nozzle insert (2) is connected to a nozzle insert receptacle (5), which has a channel (6) for the fluid, wherein the channel (6) corresponds to the nozzle opening (4). The nozzle insert (2) consists of an elastic material (7) and, in this manner, is connected to the nozzle insert receptacle (5) so that an external, free section (8) of the nozzle insert (2) along with the nozzle opening (4) is at least partially manually compressible and/or is designed to be manually bendable from its standby position (R), whereby hardened resin residue (12) can be removed from the nozzle opening (4).

4 Claims, 3 Drawing Sheets

SPRAY HEAD WITH A NOZZLE INSERT

BACKGROUND OF THE INVENTION

The invention relates to a spray head with a nozzle insert for atomizing a fluid, which tends to gum up or harden, from a reservoir, wherein the nozzle insert is substantially designed as a hollow cylinder that is open on one side and has, on the other side, a nozzle opening towards the outside, and the nozzle insert is connected to a nozzle insert receptacle, which has a channel for the fluid, wherein the channel corresponds to the nozzle opening.

Normal hair spray nozzles tend to gum up or harden with formulations for strong hair setting; this problem normally cannot be corrected by the user.

Thus, the object of the invention is to obtain a spray head with a nozzle with which it is easy to correct the gumming up/hardening of the nozzle via simple design measures while still maintaining the spray properties.

SUMMARY OF THE INVENTION

The object is achieved in that the nozzle insert consists of an elastic material and, in this manner, is connected to the nozzle insert receptacle so that an external, free section of the nozzle insert along with the nozzle opening is at least partially manually compressible and/or is designed to be manually bendable from its standby position.

If the nozzle is gummed up with resin, then the user can remove the hard resin residue from the soft nozzle by lightly deforming the nozzle, and the function will then be restored to the nozzle.

BRIEF DESCRIPTION OF THE DRAWINGS

The invention is explained in more detail by means of two exemplary embodiments.

The following is shown.

DESCRIPTION OF THE PREFERRED EMBODIMENTS

Figure 1:
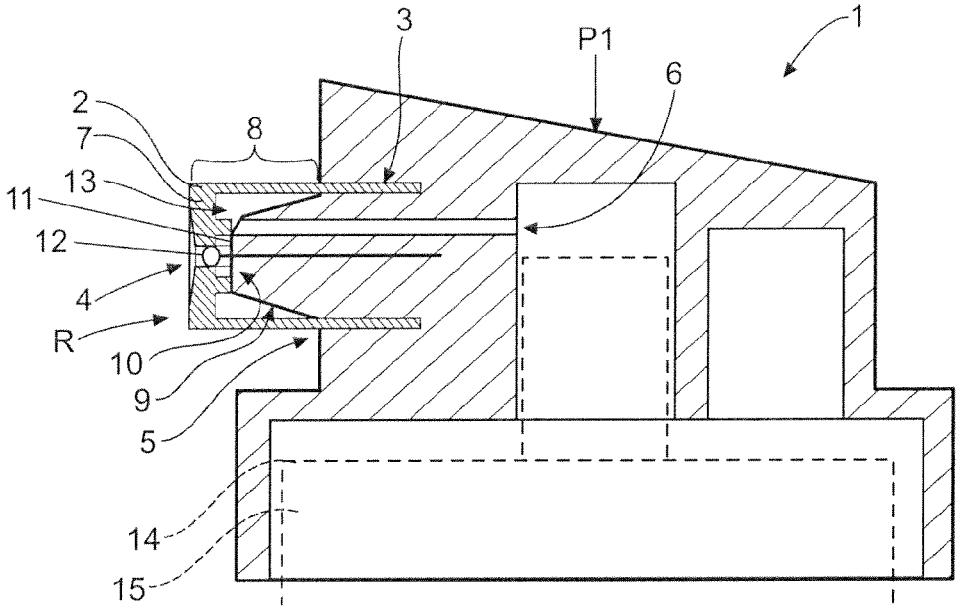
FIG. 1 shows a sectional side view of a spray head with a nozzle insert as a first exemplary embodiment, wherein the nozzle insert is in the standby position.
Figure 2:
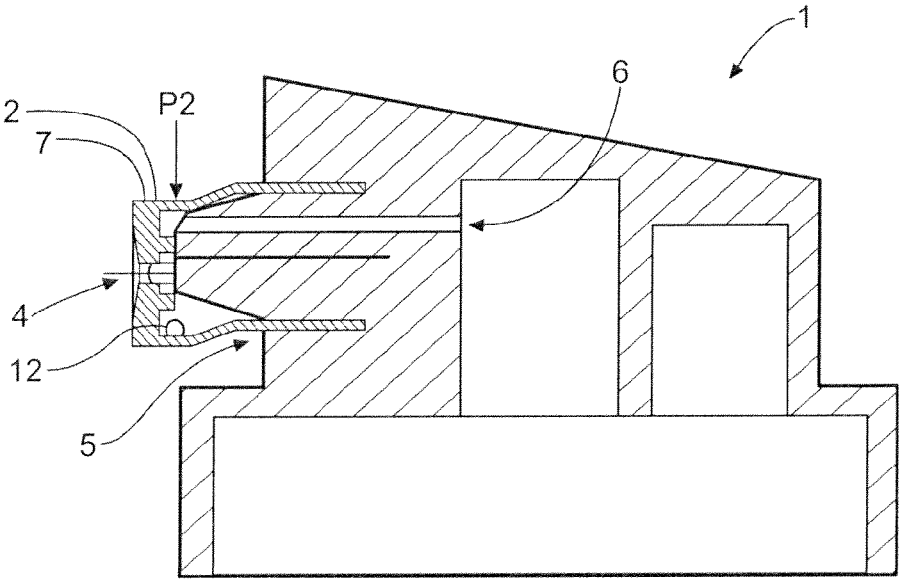
FIG. 2 shows a sectional side view of the exemplary embodiment according to FIG. 1, wherein the nozzle insert can be bent or moved by the application of force.

FIG. 1 shows a spray head 1 with a nozzle insert 2 to atomize a fluid, which tends to gum up/harden, from a reservoir, wherein the nozzle insert 2 is substantially designed as a hollow cylinder 3 open on one side and has, on the other side, a nozzle opening 4 directed outwards. The nozzle insert 2 is connected, in a fluid-impermeable manner, to a nozzle insert receptacle 5, which has a channel 6 for the fluid, wherein the channel 6 corresponds to the nozzle opening 4. The nozzle insert 2 consists of an elastic material 7 manufactured as a single injection molded part and, in this manner, is connected to the nozzle insert receptacle 5 so that an external, free section 8 of the nozzle insert 2 along with the nozzle opening 4 is at least partially manually compressible and/or is designed to be manually bendable from its standby position R. The nozzle insert receptacle 5 has a protruding taper 9 on the outside, whereby the external, free section 8 of the nozzle insert 2 along with the nozzle opening 4 is at least partially manually compressible and/or is designed to be manually bendable from its standby position R via the application of force P2. FIG. 2 illustrates this condition. By manually compressing and/or bending the free section 8 of the nozzle insert 2 or by slightly deforming the nozzle opening 4, the user can remove the resin residue 12 from the soft nozzle opening 4, with which the function is restored to the nozzle insert 2. The resin residue 12 that is removed either escapes from the nozzle opening 4 towards the outside or it falls into an inflow chamber 13 and thus is harmless.

The nozzle opening 4 has a swirl chamber 10, which is positioned on one end 11 of the protruding taper 9.

Figure 3:
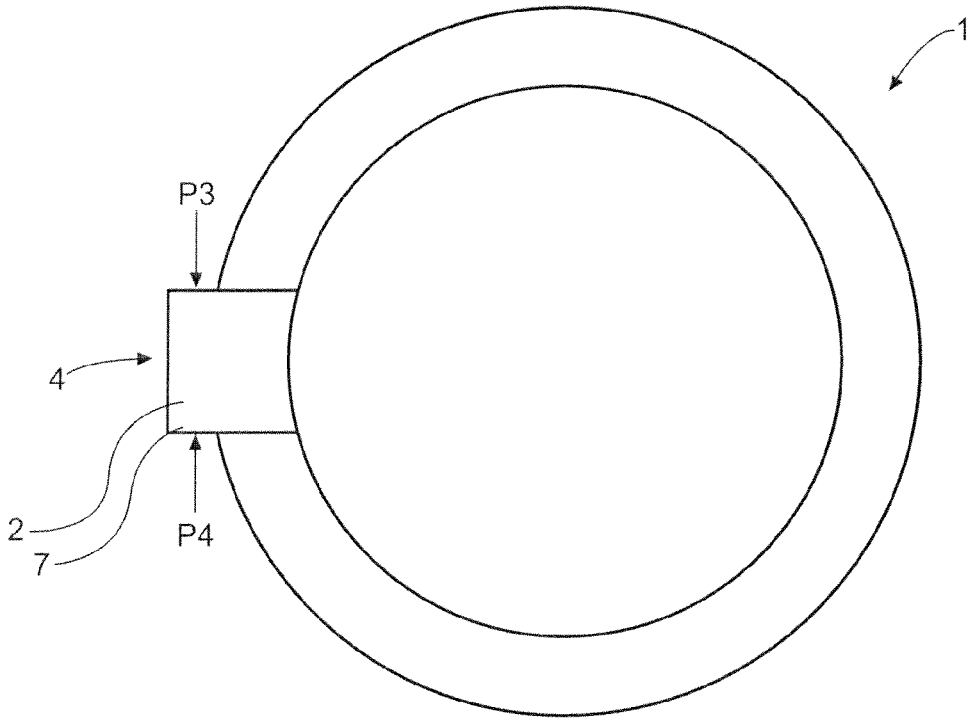
FIG. 3 shows a top view of the spray head according to FIG. 1.

FIG. 3 shows a top view of the spray head 1 according to FIG. 1, wherein a manual compression of the external, free section 8 or of the nozzle opening 4 is induced by the application of force (arrows P3, P4).

Figure 4:
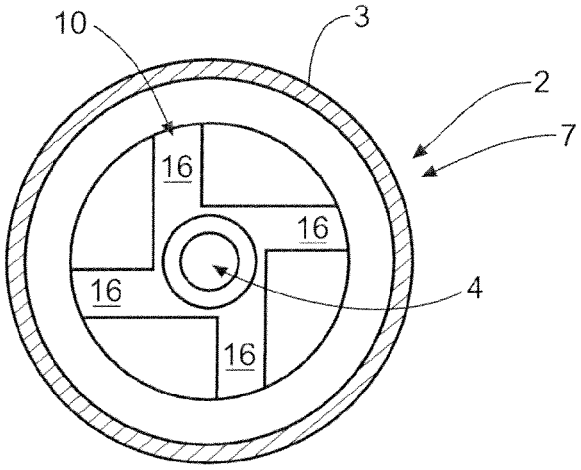
FIG. 4 shows section IV-IV of the nozzle insert according to FIG. 1.

FIG. 4 shows section IV-IV, which is the nozzle insert 2 according to FIG. 1. The swirl chamber 10 consists of four swirl channels 16.

Figure 5:
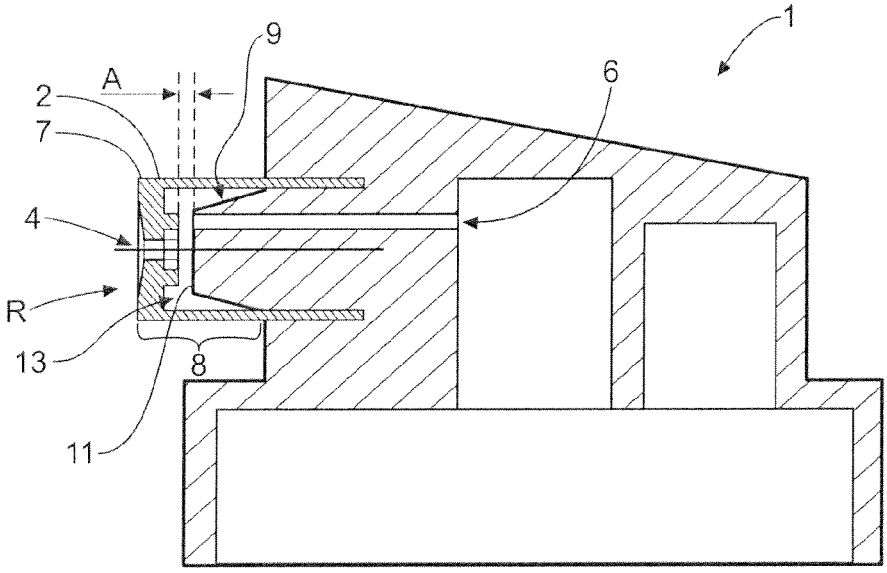
FIG. 5 shows a sectional side view of a spray head with a nozzle insert as a second exemplary embodiment, wherein the nozzle insert is in the standby position.

FIG. 5 shows a sectional side view of a spray head 1 with a nozzle insert 2 as a second exemplary embodiment, wherein the nozzle insert 2 is in the standby position. The nozzle opening 4 has a swirl chamber 10, which is arranged with a thin distance A to one end 11 of the protruding taper 9. This enables an even stronger manual compression and/or bending (application of force P5/FIG. 6) of the free section 8, which, in turn, facilitates even better removal or loosening of hard resin residue 12 from the nozzle opening 4 or from the swirl chamber 10.

Figure 6:
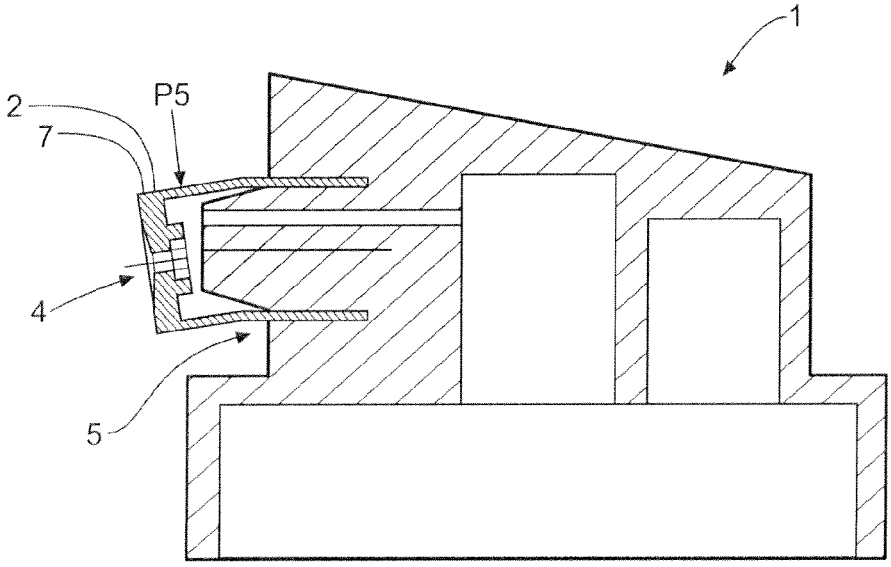
FIG. 6 shows a sectional side view of the exemplary embodiment according to FIG. 5, wherein the nozzle insert can be bent or moved by the application of force.

FIG. 6 shows a sectional side view of the exemplary embodiment according to FIG. 5, wherein the nozzle insert 2 can be bent or moved by the application of force (arrow P5).

Pressure buildup to atomize a fluid can occur, for example, using pressurized gas packaging 14 indicated by the dotted outline 14 (FIG. 1) or using a displacement pump 15 indicated by the dotted line (FIG. 1), wherein atomization is activated via manual pressure (arrow P1/FIG. 1) applied to the spray head 1.

A hair-setting agent is used as the fluid.

The use of the spray head 1 has proven to be especially advantageous because the fluid that is used is a hair-setting agent (containing resin).

REFERENCE LIST

1 Spray head
2 Nozzle insert
3 Hollow cylinder
4 Nozzle opening
5 Nozzle insert receptacle
6 Channel
7 Elastic material
8 External, free section
9 Taper
10 Swirl chamber
11 End/Taper 9
12 Hard resin residue
13 Inflow chamber
14 Pressurized gas packaging

15 Displacement pump
16 Swirl channel
A Distance
P1-5 Application of force
R Standby position All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A spray head with a nozzle insert to atomize a fluid, which tends to gum up/harden, from a reservoir, wherein the nozzle insert is substantially designed as a hollow cylinder open on one side and comprises, on the other side, a nozzle opening directed outwards, and wherein the nozzle insert is connected to a nozzle insert receptacle, the nozzle insert receptacle protrudes from the spray head with a trapezoidal cross-section which includes an upper taper and a lower taper, the upper taper includes a further taper leading to a flat front with the further taper being less acute than the upper taper, further the nozzle insert receptacle comprises a channel for the fluid, wherein the channel corresponds to the nozzle opening, wherein the nozzle insert consists of an elastic material and is connected to the nozzle insert receptacle so that an external, free section of the nozzle insert along with the nozzle opening is at least partially manually compressible and/or is designed to be manually bendable from its standby position.

2. A spray head (1) according to claim 1, wherein the nozzle opening (4) further comprising a swirl chamber (10), which is placed on one end (11) of the protruding taper (9).

3. A spray head (1) according to claim 1, wherein the nozzle opening (4) comprises a swirl chamber (10), which is arranged with a thin distance (A) to one end (11) of the protruding taper (9).

4. A spray head (1) according to claim 1, wherein the fluid comprises a hair-setting agent.

* * * * *